US007087002B2

(12) United States Patent
Montgomery

(10) Patent No.: US 7,087,002 B2
(45) Date of Patent: Aug. 8, 2006

(54) EXERCISE CANE

(76) Inventor: Robert D. Montgomery, 1685 W. 12th St., Reno, NV (US) 89503

( * ) Notice: Subject to any disclaimer, the term of this patent is extended or adjusted under 35 U.S.C. 154(b) by 538 days.

(21) Appl. No.: 10/462,869

(22) Filed: Jun. 17, 2003

(65) Prior Publication Data

US 2004/0259699 A1 Dec. 23, 2004

(51) Int. Cl.

| | |
|---|---|
| ***A63B 21/02*** | (2006.01) |
| ***A63B 71/00*** | (2006.01) |
| ***A45B 1/00*** | (2006.01) |

(52) U.S. Cl. ..... 482/121; 482/51; 135/65

(58) Field of Classification Search ..... 482/75–77, 482/74, 109, 50–51, 121–123; 135/66, 75, 135/76, 72

See application file for complete search history.

(56) References Cited

U.S. PATENT DOCUMENTS

| | | | | | |
|---|---|---|---|---|---|
| 4,809,725 | A * | 3/1989 | Champigny | 135/75 |
| 5,056,545 | A * | 10/1991 | Spaeth | 135/66 |
| 5,469,343 | A * | 11/1995 | Speck | 362/102 |
| 5,495,867 | A * | 3/1996 | Block | 135/65 |
| 5,771,910 | A * | 6/1998 | Kluttz | 135/68 |
| 5,941,262 | A * | 8/1999 | Tschirhart | 135/65 |
| 6,085,766 | A * | 7/2000 | Geary | 135/75 |
| 6,328,048 | B1 * | 12/2001 | Rivera, Sr. | 135/66 |
| 6,394,116 | B1 * | 5/2002 | Winn et al. | 135/65 |
| 6,745,786 | B1 * | 6/2004 | Davis | 135/65 |

* cited by examiner

*Primary Examiner*—Gregory L. Huson
*Assistant Examiner*—Fenn C. Mathew

(57) ABSTRACT

An exercise cane that can be used for mobility, but it is also constructed for use as an exercise device while walking or jogging. The cane also includes optional features such as a battery operated light, a storage compartment, a drinking bottle with a container therefore, and a novel drinking straw that allows a user to take a drink without interrupting the physical workout.

14 Claims, 2 Drawing Sheets

EXERCISE CANE

FIELD OF THE INVENTION

The present invention relates generally to exercising accessories, and more particularly to an improved exercise walking stick for hand-manipulative use while walking or jogging and which simultaneously provides a walker or jogger with an enhanced healthy muscular aerobic workout. The present cane also provides a removably attached fluid container with mounting means and an easily accessible straw that allows a user to drink while exercising so as to eliminate the need to stop and interrupt the workout.

BACKGROUND OF THE INVENTION

The benefits of low-impact aerobic exercises have become well known to exercise enthusiasts over the past several years. Sports such as walking, swimming, and bicycling offer many of the same benefits as high impact forms of exercise, but do not place as much strain on the participant's body. Walking has always been advocated as a beneficial health measure, and is currently the most popular form of exercise. In fact, recent polls show that some 200 million people walk for exercise. Low impact walking exercises provide a means of exercise for nearly everyone, regardless of age or cardiovascular condition. Walking exercises serve to strengthen the heart and lungs, making them work more efficiently.

Studies have shown that this easy to perform, natural activity can provide powerful health benefits including reduced anxiety, weight loss, reduced cholesterol levels, controlled hypertension, improved cardiovascular health, and slowed aging. Walking exercises also improve muscle and skeletal strength, particularly in the walker's arms and legs. Walking exercises much of the walker's body to at least some extent, though walkers have found it advantageous to enhance the workout to the walker's upper body and to increase the muscular workout available to the walker's lower body. The recent increase in interest and participation in walking exercises has led to the development of exercising accessories to be used in conjunction with a walker's regime or light jogger's workout. More particularly, walkers have a desire to incorporate into their walking routine some form of enhanced muscular exercise, so as to provide them with not only exercise but also to provide entertainment and mental activity while exercising. This is very important, as it has been proven that the heart muscles as well as the entire cardiovascular system are stimulated through mental activity.

One drawback as frequently taught within the known prior art walking aids, is the fact most of these aids integrate some type of exercise device which allow for twisting or flexing the muscles, but is not accomplished in a safe and healthy isometric manner. Unfortunately, such devices all include springs or metal devices and these do not provide proper muscle interaction and if a user is not knowledgeable as to how muscles actually function, they can easily hurt themselves with these devices. Springs and metal are not only dangerous but they are also very unpredictable, as due to use and wear and more importantly varying temperatures effect the overall performance.

Another disadvantage within the known prior art includes the fact that none of these devices incorporate a drinking bottle therewith. This is again very important, as it has become well known that dehydration is a major factor to consider and resolve while exercising.

SUMMARY OF THE INVENTION

It is therefore an object of the present invention to provide an exercise cane which is not only helpful for users to gain mobility but also provides a safe and healthy walking aid which will not cause harm to the user when used correctly.

Yet another important object of the present invention is to provide an exercise cane that incorporates use of a water bottle and removable holder so as to allow the user to easily drink while still performing an exercise. This is important as this allows the user to wet the mouth allowing the body to create an instant vapor and/or allow the user to swallow the water to get a direct liquid for hydration of the body. This is easily accomplished with the present invention as it not only provides the bottle and a holder therefore, but it further includes a drinking aid such as a straw that can be mounted within the device with its exit being accessible for immediate use from the top or handle grip. Thus the user can easily have a sip or drink while not interrupting the rhythmic walking or jogging motion that would deter from the overall performance and ultimate goal of exercising while using the cane. Also, the cane may be filled with water as an alternative.

Yet another very important object of the present invention is to provide an exercise cane that allows the user to perform isometric exercises in a safe healthy manner that will not harm the users muscles. The novel feature which allows this, is the fact that the cane incorporates a Neoprene™ internal insert which may be embedded with strings of elasticity that provide novel and unusual results. Namely, the Neoprene™ because of the elasticity simulates the muscles normal movement and this allows constant flow, this is very different than mechanical springs or the like. Thus the present invention is engineered with this in mind so as to provide a cane which when used while exercising will activate the mind and have the mind synchronize with the muscle movement and balance while walking or jogging. This in turn forces the mind to determine sight, balance, minimum and maximum endurance use, based upon durometers. The smooth easy movement provided by the Neoprene™ cause the skeletal muscles that coordinate and judge the tension to expand and contract. Thus this allows the muscles to function in a normal manner, whereas if an exercise is performed to an extreme or too lacking in manner, this can possibly cause damage. This is very important as the fibers that are embedded in the human muscle rely upon a constant and smooth rhythm allowing the fibers to grow in a stable manner to synchronize with the heart under the control of the mind. These muscles are called "memory muscles". When the cane is in motion the more level and more controlled the repetition the better it serves its purpose. For example, the more it is used with the individual, the more the Neoprene™ and elasticity simulates the muscle as well as the muscle meets the movement of the device, because of the repetition.

Still another object of the present invention is to provide an exercise cane that includes a storage compartment for containment of personal items pertaining to the user, such as keys, identification, money, etc. Thus, the user need not carry an additional item such as a wallet or the like.

Yet another object of the present invention is to provide an exercise can that not only provides a comfortable first hand grip, but may also include a second hand grip so as to allow the user to perform specific arm and/or back exercises.

Another object of the present invention is to provide an exercise can that may also include a battery operated light as an option, so as to provide visual aid for the user.

Other objects and advantages will be seen when taken into consideration with the following specification and drawings.

DETAILED DESCRIPTION OF THE DRAWINGS

Figure 1:
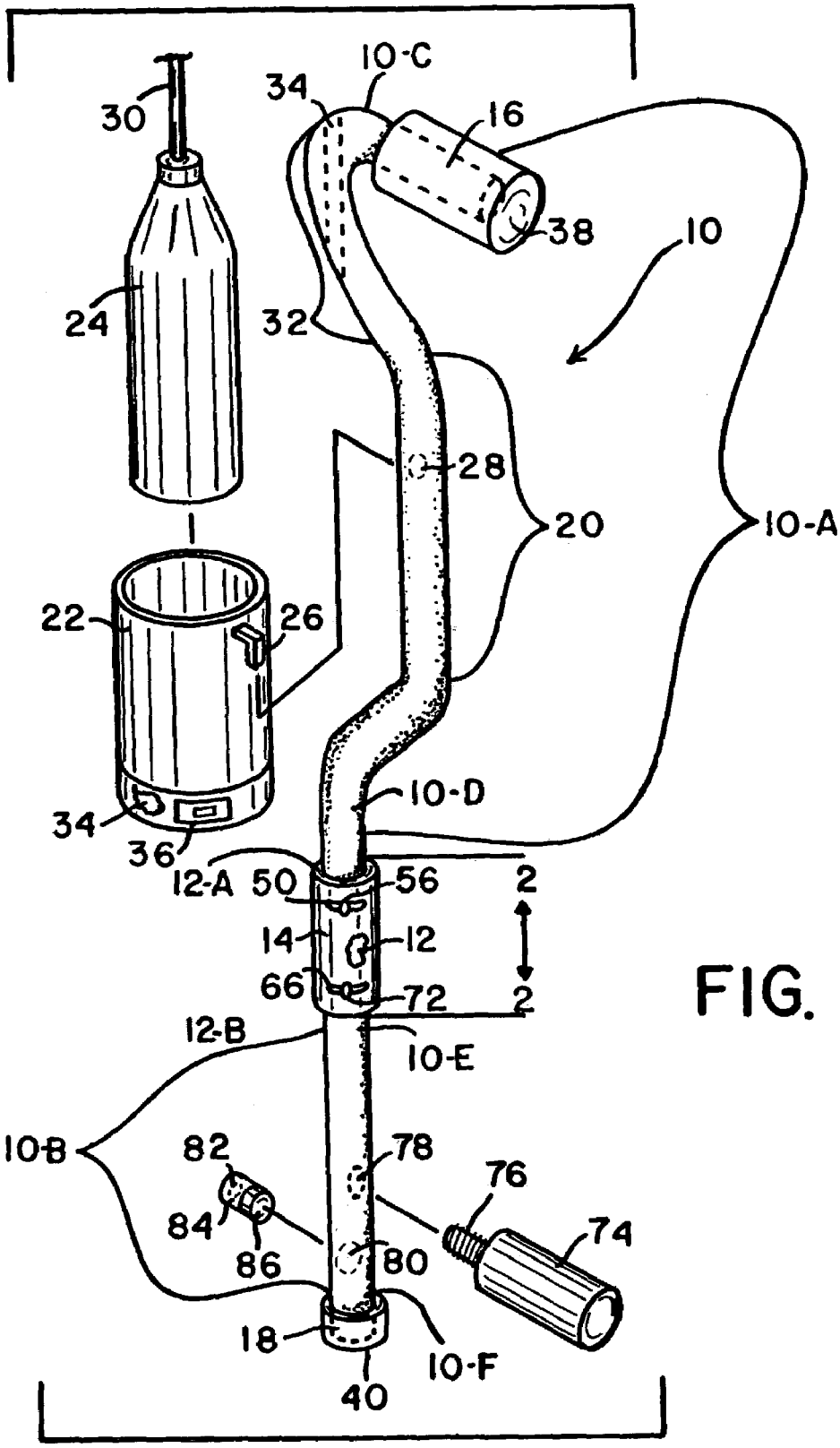
FIG. 1 substantially illustrates a perspective overview of the preferred embodiment for the present invention.

Referring now in detail to the drawings wherein like characters refer to like elements throughout the various views. As depicted in FIG. 1, (10) is an overview of the preferred embodiment for the exercise cane of the present invention. It is to be understood cane (10) can be made from any suitable materials of engineering choice, such as steel, aluminum, wood, etc., and includes the following components respectively. Cane (10), being an elongated member that is formed from a top section (10-A) and a bottom section (10-B). Top section (10-A) includes a top end (10-C) and a bottom end (10-D), and bottom section (10-B) includes a top end (10-E) and a bottom end (10-F), each of which are depicted in FIG. 1.

Figure 2:
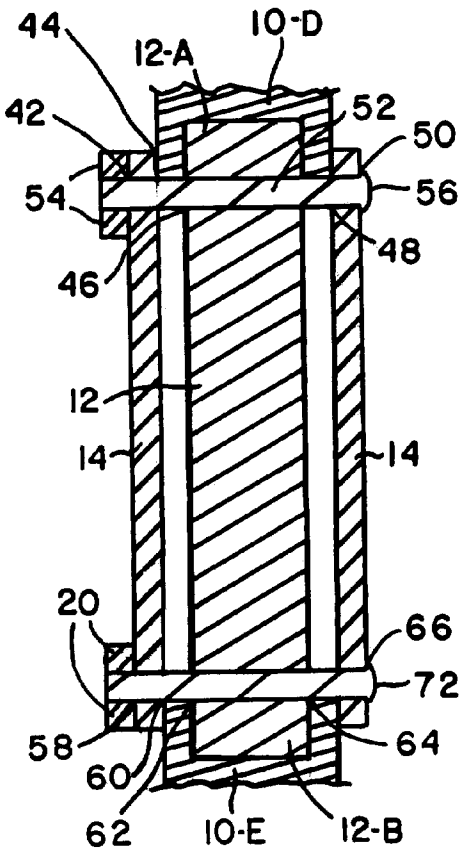
FIG. 2 is substantially an enlarged sectional cut-a-way view taken at 2—2 of FIG. 1.

With reference to FIG. 2, depicted therein is an enlarged cross sectional view taken at 2—2 of FIG. 1. Wherein, the bottom end (10-D) of top section (10-A) is attached by a first suitable attachment means (later described) onto a first end (12-A) of an internal flexible resilient insert member (12) and the top end of bottom section (10-E) is attached by a second attachment means (later described) onto a second end (12-B) of internal flexible resilient insert member (12). It is to be noted any suitable type of attachment means of engineering choice may be incorporated such as glue, bolts and nuts, etc. Bottom end (10-D) of top section (10-A) with internal flexible resilient insert member (12) and top end of bottom section (10-E) each being externally covered by a sleeve member (14). Whereby, when attached the bottom end (10-D) of top section (10-A) has a partial rotational relationship with internal flexible resilient insert member (12) and the top end (10-E) of bottom section (10-B) has a partial rotational relationship with internal flexible resilient insert member (12). As further seen in FIG. 1, top end (10-C) of top section (10-A) is shaped to form substantially a handle (16) and bottom end (10-F) of bottom section (10-B) providing a ground contact surface (18).

As further depicted in FIG. 1, exercise can (10) also includes a central section (20) between handle (16) and the bottom end (10-D) of top section (10-A). Central section (20) having attachment means for removably attaching and supporting a bottle container (22) thereon and the bottle container (22) is of a shape and size to removably receive a bottle (24) therein. Again, any suitable type of attachment means of engineering choice may be incorporated. However as depicted herein one suitable type of attachment means includes bottle container (22) having a fixedly attached and/or integrally formed upside-down L-shaped protrusion (26), and exercise cane (10) includes a cavity (28) which is of a shape and size to slidably yet removably receive upside-down L-shape protrusion (26) therein. Whereby, bottle (24) and bottle container (22) can each be easily removed for cleaning and/or filling.

With further reference to FIG. 1, it can clearly be seen that bottle (24) further includes a drinking straw (30) that protrudes upward and outwardly there from. As can further be seen therein, central section (20) and handle (16) are interconnected by a neck portion (32) with the neck portion (32) having a vertical bore (34) there through which is of a shape and size to slidably receive drinking straw (30) there through. Furthermore, central section (20) is of a shape and size to allow water bottle (24) with drinking straw (30) and vertical bore (34) to be in alignment with each other, respectively.

FIG. 1 also depicts that bottle container (22) further includes a storage compartment (34) for containment and storage of a user's personal items of choice, such as keys, money, etc., and storage compartment includes some type of suitable open/closure means of engineering choice, such as an access panel (36). Further illustrated therein, handle (16) may also include a frictionally engaged handgrip (38). Again any suitable type of handgrip and attachment means may be used according to engineering and/or consumer choice. Still further, ground contact surface (18) includes a frictionally engaged non-skid cup (40) that helps to increase gripping the ground surface.

With reference now to FIG. 2, wherein the previously noted first and second attachment means will now be described. The first attachment means being an attachment means for fixedly attaching bottom end (10-D) of top section (10-A) onto a first end (12-A) of internal flexible resilient insert member (14). The first attachment means includes sleeve member (14) having a first horizontal bore (42) that is formed through a first section of a sidewall of sleeve member (14). A second horizontal bore (44) is formed through a first section of a sidewall of bottom end (10-D) of top section (10-A). A third horizontal bore (46) is formed through the first end (12-A) of internal flexible resilient insert member (12). A fourth horizontal bore (48) is formed through a second section of a sidewall of bottom end (10-D) of top section (10-A). A fifth horizontal bore (50) is formed through a second section of a sidewall of sleeve member (14). It can clearly be seen in FIG. 2 that each horizontal bore (42–50) are in alignment with each other, and each bore in combination form an elongated opening which is of a shape and size to slidably receive and retain a pin (52) there through. Pin (52) includes a first end that is secured by a fastener, such as a nut (54) and a second end (56) that is enlarged forming a bulb shape, respectively. It is to be noted, first horizontal bore (42) and fifth horizontal bore (50) are each substantially shaped in the form of an elongated oval so as to allow pin (52) to be movable horizontally therein. Thus, providing a partial rotational relationship between bottom end (10-D) of top section (10-A) and sleeve member (14).

The second attachment means being an attachment means for fixedly attaching top end (10-E) of bottom section (10-B) onto a second end (12-B) of internal flexible resilient insert member (14). The second attachment means includes a sixth horizontal bore (58) that is formed through a third section of a sidewall of sleeve member (14). A seventh horizontal bore (60) is formed through a first section of a sidewall of top end (10-E) of bottom section (10-B). An eighth horizontal bore (62) is formed through a second end (12-B) of internal flexible resilient insert member (12). A ninth horizontal bore (64) is formed through a second section of a sidewall of top end (10-E) of bottom section (10-B). A tenth horizontal bore (56) is formed through a fourth section of a sidewall of sleeve member (14). It can clearly be seen in FIG. 2 that each horizontal bore (58–66) are in alignment with each other, and each bore in combination form an elongated opening which is of a shape and size to slidably receive and retain a second pin (68) there through. Pin (68) includes a first end that is secured by a fastener, such as a second nut (70) and a second end (72) that is enlarged forming a bulb shape, respectively. It is to be noted, sixth horizontal bore (58) and tenth horizontal bore (66) are each substantially shaped in the form of an elongated oval so as to allow second pin (68) to be movable horizontally therein. Thus, providing a partial rotational relationship between top end (10-E) of bottom section (10-B) and sleeve member (14).

With reference again to FIG. 1, as depicted therein bottom section (10-B) further includes a lower section, respectively, which includes attachment means for removably attaching a second handgrip (74) thereon. It is to be understood any suitable attachment means of engineering choice may incorporated such as a friction fit, nuts and bolts, etc., thus the attachment means as taught herein is only exemplary. Wherein, second handgrip (74) includes an elongated threaded extension member (76) and lower section of bottom section (10-B) includes a threaded bore (78) that is of a shape and size to threadably receive elongated threaded extension member (76) therein. Whereby, removably attaching second handgrip (74) onto the lower section of bottom section (10-B).

Referring again to FIG. 1, as depicted therein the lower section of bottom section (10-B) further includes attachment means for removably attaching a light source thereon. Again any suitable type of attachment means and/or light source may be used according to engineering choice. For example as taught herein, the light source (82) is battery operated and contained within a housing (84), with housing (84) having a rubberized extension member (86), and lower section of bottom section (10-B) includes a bore (80) therein. Whereby, rubberized extension member (86) may be frictionally engaged within bore (80) and held in a secure manner.

Figure 3:
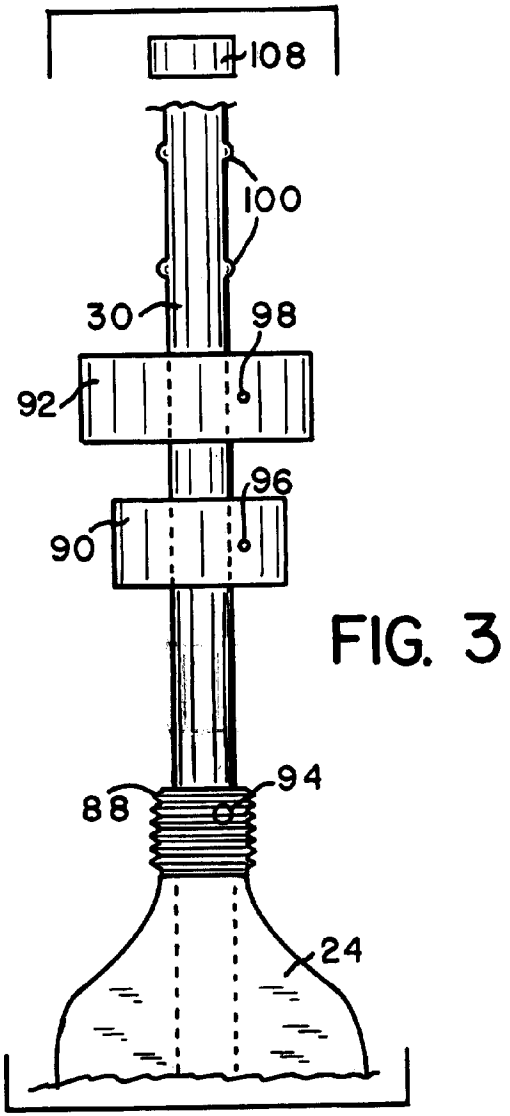
FIG. 3 is substantially a plan view for a novel drinking bottle with a straw and two open/closure caps.

Referring now to FIG. 3, wherein the preferred embodiment for bottle (24) is further defined. It is to be noted any suitable type of bottle may be used, however the application herein describes a novel type of bottle, cap members and straw in combination that provides unusual results as addressed within the following description. However, it is to be understood the following description is only exemplary of one suitable means for defining the unusual results of the present invention. Namely providing a drinking bottle with a cap or caps and straw system that can be used in connection with the exercise cane (10) that allows the user to easily take a drink without interrupting their workout. This is accomplished by providing a straw that protrudes from a top portion of cape (10), and due to the construction of the bottle, caps or caps, and straw in combination the user need not remove any cap to obtain a drink there from.

Bottle (24) and drinking straw (30) further include bottle (24) having a threaded neck (88), a threaded cap member (90) and a threaded sealing cap member (92) in combination. It is to be noted that threaded cap member (90) is of the standard type normally associated with such drinking bottles and is of a shape and size to be threadably engaged onto threaded neck (88) and threaded sealing cap member (92) is of a shape and size to be threadably engaged onto threaded cap member (90). As depicted herein, threaded neck (88) includes a vertical bore there through, (depicted in ghost lines), threaded cap member (90) includes a vertical bore there through (depicted in ghost lines), and threaded sealing cap member (92) includes a vertical bore there through (depicted in ghost lines). Thus as can be seen herein, each vertical bore is in vertical alignment with each other and each bore in combination are of a shape and size to slidably receive drinking straw (30) therein. Threaded neck (88) includes a horizontal hole (94) therein, threaded cap member (90) includes a horizontal hole (96) therein, and threaded sealing cap member includes a horizontal hole (98) therein. Thus it can be seen that each horizontal hole (94, 96 & 98), can be positioned into horizontal alignment with each other. Whereby resulting in bottle (24) assuming or being in a non-sealed open position and this allows air input, which in turn allows fluid contained in bottle (24) to be easily withdrawn up through straw (30) when a user sips there from but liquid will not leak from either of the caps as they are still substantially sealed. However, when each of the horizontal holes (94, 96, & 98) are not in horizontal alignment the bottle (24) assumes or is considered to be in a sealed completely closed position, and fluid cannot be withdrawn there from until each of the holes are returned to there aligned position. It is to be noted that the user can easily open or close bottle (24) by simply turning the cap, or caps 1/16th of a turn, respectively. It is to be further noted that these unusual results can be accomplished with only one cap, or multiples caps, and/or the holes may be either within the top sections or side sections, depending on engineering choice.

Further depicted in FIG. 3, drinking straw (30) further includes an exterior surface having multiple spaced apart protruding ribs (100) thereon. Also, vertical bore of threaded sealing cap member (92) is of a shape and size to frictionally receive and mate, respectively, with each one of the multiple spaced apart protruding ribs (100) when one of the ribs are positioned therein, whereby straw (30) is variably adjustable in length. This allows the user to easily position the straw to a position of their linking. Furthermore, drinking straw (30) may also include a removable frictionally engaged top end closure cap (102) so as to allow the user to completely close off the straw when it is not used for drinking, this also may be used for sanitary purposes.

As a final note, it is to be understood that at the point of manufacture, the resilient member (12) can be made having variable resiliency depending on the hardener's blend used in the manufacturing process. This is very important as this allows for the manufacturer to provide an exercise cane designed to needs and muscle memory for individual users. Thus, a personalized cane can be made. For example, if an athlete orders a cane they would need a cane having less resiliency when compared to a person who is less athletic, and/or a child or handicapped person would require.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. An exercise cane comprising: an elongated member which is formed from a top section and a bottom section, said top section having a top end and a bottom end, said bottom section having a top end and a bottom end, said bottom end of said top section being attached by a first attachment means onto a first end of an internal flexible resilient insert member, said top end of said bottom section being attached by a second attachment means onto a second end of said internal flexible resilient insert member, said bottom end of said top section with said internal flexible resilient insert member and said top end of said bottom section each being externally covered by a sleeve member, said bottom end of said top section having a partial rotational relationship with said internal flexible resilient insert member, said top end of said bottom section having a partial rotational relationship with said internal flexible resilient insert member, said top end of said top section being shaped to form a handle, said bottom end of said bottom section providing a ground contact surface, said top section further includes a central section between said handle and said bottom end of said top section, a bottle container housing a bottle, said central section having attachment means for removably attaching and supporting said bottle container thereon, said bottle container being of a shape and size to removably receive said bottle therein, said bottle having a drinking straw protruding upward and outwardly there from, said central section and said handle being interconnected by a neck portion, said neck portion having a vertical bore there through, said vertical bore being of a shape and size to slidably receive said drinking straw there through, and said central section being of a shape and size to allow said bottle with said drinking straw and said vertical bore to be in alignment with each other.

2. The exercise cane of claim 1 wherein said bottle container further includes a storage compartment having open/closure means.

3. The exercise cane of claim 1 wherein said handle further includes a frictionally engaged handgrip.

4. The exercise cane of claim 1 wherein said ground contact surface further includes a frictionally engaged non-skid rubber cup.

5. The exercise cane of claim 1 wherein said bottom section further includes a lower section, said lower section having attachment means for removably attaching a handgrip thereon.

6. The exercise cane of claim 5 wherein said attachment means includes said handgrip having an elongated threaded extension member, and said lower section having a threaded bore therein that is of a shape and size to threadably receive said elongated threaded extension member therein.

7. The exercise cane of claim 1 wherein said bottom section further includes a lower section, said lower section having attachment means for removably attaching a light source thereon.

8. The exercise cane of claim 7 wherein said light source is battery operated, said light source is contained within a housing, said housing having a rubberized extension member, said attachment means including said lower section having a bore therein and said rubberized extension member being of a shape and size to be frictionally engaged within said threaded bore.

9. The exercise cane of claim 1 wherein said bottle and said drinking straw in combination further comprising: said bottle having a threaded neck; a threaded cap member; and a threaded sealing cap member; said threaded cap member being of a shape and size to be threadably engaged onto said threaded neck, said threaded sealing cap member being of a shape and size to be threadably engaged onto said threaded cap member, said threaded neck having a vertical bore there through, said threaded cap member having a vertical bore there through, said threaded sealing cap member having a vertical bore there through, each said vertical bore being in vertical alignment with each other, each said bore in combination being of a shape and size to slidably receive said drinking straw there through, said threaded neck having a horizontal hole therein, said threaded cap member having a horizontal hole therein, said threaded sealing cap member having a horizontal hole therein, each said horizontal hole being in horizontal alignment when said bottle is in a non-sealed open position and each said horizontal hole not being in horizontal alignment when said bottle is in a sealed closed position.

10. The exercise cane of claim 9 wherein said straw further includes an exterior surface having multiple spaced apart protruding ribs thereon, said vertical bore of said threaded sealing cap member being of a shape and size to frictionally receive and mate with each one of said multiple spaced apart protruding ribs when positioned therein, whereby, said straw is variably adjustable in length.

11. The exercise cane of claim 10 wherein said straw further includes a removable top end closure cap.

12. An exercise cane comprising: an elongated member which is formed from a top section and a bottom section, said top section having a top end and a bottom end, said bottom section having a top end and a bottom end, said bottom end of said top section being attached by a first attachment means onto a first end of an internal flexible resilient insert member, said top end of said bottom section being attached by a second attachment means onto a second end of said internal flexible resilient insert member, said bottom end of said top section with said internal flexible resilient insert member and said top end of said bottom section each being externally covered by a sleeve member, said bottom end of said top section having a partially rotational relationship with said internal flexible resilient insert member, said top end of said bottom section having a partial rotational relationship with said internal flexible resilient insert member, said top end of said top section being shaped to form a handle, said bottom end of said bottom section providing a ground contact surface, said first attachment means comprising: a first horizontal bore; a second horizontal bore; a third horizontal bore; a fourth horizontal bore; a fifth horizontal bore; and a pin; said first horizontal bore being formed through a first section of a side wall of said sleeve member, said second horizontal bore being formed through a first section of a side wall of said bottom end of said top section, said third horizontal bore being formed through said first end of said internal flexible resilient insert member, said fourth horizontal bore being formed through a second section of said side wall of said bottom end of said top section, said fifth horizontal bore being formed through a second section of a side wall of said sleeve member, each said horizontal bore being in alignment with each other, each said bore in combination form an elongated opening which is of a shape and size to slidably receive and retain said pin there through, said first horizontal bore and said fifth horizontal bore each being shaped in the form of an elongated oval so as to allow said pin to be movable horizontally therein, thus providing said partial rotational relationship between said bottom end of said top section and said sleeve member, said second attachment means comprising: a sixth horizontal bore; a seventh horizontal bore; an eighth horizontal bore; a ninth horizontal bore; a tenth horizontal bore; and a second pin; said sixth horizontal bore being formed through a third section of said side wall of said sleeve member, said seventh horizontal bore being formed through a first section of a side wall of said top end of said bottom section, said eighth horizontal bore being formed through said second end of said internal flexible resilient insert member, said ninth horizontal bore being formed through a second section of said side wall of said top end of said bottom section, said tenth horizontal bore being formed through a fourth section of said side wall of said sleeve member, horizontal bores six thru ten each being in alignment with each other, said horizontal bores six thru ten in combination form an elongated opening which is of a shape and size to slidably receive and retain said second pin there through, said sixth horizontal bore and said tenth horizontal bore each being shaped in the form of an elongated oval so as to allow said second pin to be movable horizontally therein, thus providing said partial rotational relationship between said top end of said bottom section and said sleeve member.

13. The exercise cane of claim 12 wherein said internal flexible resilient insert member is made from Urethane™, or a variant thereof.

14. The exercise cane of claim 12 wherein said elongated member is made from aluminum.

* * * * *